US010935909B2

(12) United States Patent
Kurosu

(10) Patent No.: US 10,935,909 B2
(45) Date of Patent: Mar. 2, 2021

(54) IMAGE FORMING APPARATUS INCLUDING TRANSFER ROLLER TO TRANSFER TONER IMAGE FROM IMAGE BEARING MEMBER TO BELT

(71) Applicant: CANON KABUSHIKI KAISHA, Tokyo (JP)

(72) Inventor: Yuki Kurosu, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/823,080

(22) Filed: Mar. 18, 2020

(65) Prior Publication Data

US 2020/0218178 A1 Jul. 9, 2020

Related U.S. Application Data

(63) Continuation of application No. 16/523,671, filed on Jul. 26, 2019, now Pat. No. 10,635,029.

(30) Foreign Application Priority Data

Aug. 1, 2018 (JP) ..... 2018-145134

(51) Int. Cl.
*G03G 15/16* (2006.01)

(52) U.S. Cl.
CPC ..... *G03G 15/1665* (2013.01); *G03G 15/1605* (2013.01); *G03G 15/1615* (2013.01)

(58) Field of Classification Search
CPC ..... G03G 15/0131; G03G 15/0178; G03G 15/0184; G03G 15/0189; G03G 15/1605; G03G 15/1615; G03G 15/1665; G03G 15/1685; G03G 2215/0119; G03G 2215/0122; G03G 2215/0125; G03G 2215/0132
See application file for complete search history.

(56) References Cited

U.S. PATENT DOCUMENTS

2005/0063739 A1* 3/2005 Kobayashi ..... G03G 15/0131 399/299
2005/0185991 A1* 8/2005 Iwakura ..... G03G 15/0131 399/299
2012/0308272 A1* 12/2012 Nakaegawa ..... G03G 15/0189 399/302
2013/0022380 A1* 1/2013 Murakami ..... G03G 15/0189 399/313

(Continued)

*Primary Examiner* — Sophia S Chen
(74) *Attorney, Agent, or Firm* — Canon U.S.A. Inc., IP Division

(57) ABSTRACT

A position of a stretch roller, where the stretch roller stretches an intermediate transfer belt upstream of and adjacently to a most upstream primary transfer roller in a rotational direction of the intermediate transfer belt, is apart from a photosensitive drum with respect to a primary transfer surface. Further, the most upstream primary transfer roller is larger in outside diameter than other primary transfer rollers, and the most upstream primary transfer roller has a transfer pressure larger than the transfer pressure of the other primary transfer rollers. This arrangement inhibits the most upstream primary transfer roller from deforming and a defective transfer due to waving of the intermediate transfer belt, while inhibiting an increase in size of an apparatus.

10 Claims, 10 Drawing Sheets

(56) References Cited

U.S. PATENT DOCUMENTS

| | | | | |
|---|---|---|---|---|
| 2014/0270840 | A1* | 9/2014 | Kudo | G03G 15/161<br>399/101 |
| 2017/0277111 | A1* | 9/2017 | Shibuya | G03G 15/0131 |
| 2017/0336738 | A1* | 11/2017 | Ohta | G03G 15/1665 |

* cited by examiner

A-A CROSS-SECTIONAL VIEW

IMAGE FORMING APPARATUS INCLUDING TRANSFER ROLLER TO TRANSFER TONER IMAGE FROM IMAGE BEARING MEMBER TO BELT

CROSS-REFERENCE TO RELATED APPLICATIONS

This application is a continuation of U.S. patent application Ser. No. 16/523,671 filed Jul. 26, 2019, which claims the benefit of Japanese Patent Application No. 2018-145134, filed Aug. 1, 2018, all of which are hereby incorporated by reference herein in their entirety.

BACKGROUND

Field

The present disclosure relates to an image forming apparatus, such as a copying machine, a printer, or a facsimile machine, with electrophotography or electrostatic recording.

Description of the Related Art

Recently, a full-color tandem mechanism has been proposed for formation of a color image at high speed with high image quality, as an image forming apparatus such as a printer, a copying machine, or a facsimile machine. A representative example of the tandem mechanism has a structure in which four image forming stations for yellow (Y), magenta (M), cyan (C), and black (K) are arranged in an array in a movement direction of an intermediate transfer belt. In the structure, respective toner images in yellow, magenta, cyan, and black sequentially formed by the image forming stations are transferred onto the intermediate transfer belt in superimposition (primary transfer). After that, the toner images are collectively transferred from the intermediate transfer belt onto a recording medium (secondary transfer). Then, the toner images formed on the recording medium are fixed to form an image in full color or monochrome.

A primary transfer portion is often formed by arrangement of a primary transfer roller through a photosensitive drum on which a toner image is formed and the intermediate transfer belt. A structure has been known in which a metal roller is used as such a primary transfer roller (refer to Japanese Patent Application Laid-Open No. 2016-173503). In a case where the metal roller that is a rigid roller is used, the metal roller has no elasticity. Accordingly, there is a possibility that the metal roller opposed to the photosensitive drum through only the thickness of the intermediate transfer belt damages the photosensitive drum. Thus, in a case where the metal roller that is rigid is used, the metal roller is shifted (offset) downstream of the photosensitive drum to use the elasticity of the intermediate transfer belt, thereby preventing the metal roller from damaging the photosensitive drum. Urging force is applied to the primary transfer roller such that the belt presses against the photosensitive drum. Driven rollers are arranged upstream of and downstream of the primary transfer portion, resulting in formation of a primary transfer surface.

However, the arrangement of the driven rollers upstream of and downstream of the primary transfer portion increases the cross section of a unit, resulting in an increase in the size of an apparatus, an increase in the peripheral length of the intermediate transfer belt, and an increase in the cost of the driven rollers. Thus, elimination of the driven roller upstream of the primary transfer portion enables solution of the above issue. However, in a case where the upstream driven roller is eliminated, there is an issue that formation of the primary transfer surface is unstable in a most upstream side. In a conventional configuration in which a transfer nip is formed between a primary transfer roller having elasticity and a photosensitive drum, even without regulating roller arranged upstream of the primary transfer roller, the nip formed between the primary transfer roller and the photosensitive drum can remove the influence of waving.

Even without transfer nip formed between the primary transfer roller and the photosensitive drum through the belt as described above, it is required that a stable primary transfer surface is formed. Thus, it has been examined that enhancement of the urging force for urging the most upstream primary transfer roller toward an inner surface of the belt to inhibit the influence of belt waving occurring upstream of the primary transfer roller. However, enhancement of the urging force for urging the primary transfer roller causes the primary transfer roller to deform, resulting in occurrence of a defective transfer. It can be considered that the primary transfer roller is made larger in diameter to inhibit the primary transfer roller from deforming, but the larger diameter causes an increase in cost and prevents a reduction in weight.

SUMMARY

The present disclosure is directed to a transfer unit enabling a reduction in size of an apparatus and a reduction in cost while inhibiting belt waving from influencing transferring, even without transfer nip formed between a primary transfer roller and a drum through a belt.

According to an aspect of the present disclosure, an image forming apparatus includes a first image-bearing member configured to bear a toner image, a second image-bearing member configured to bear a toner image, a belt, which is movably provided, configured to be in contact with the first image bearing member at a first contact position where the image is transferred from the first image bearing member and to be in contact with the second image bearing member at a second contact position, where the image is transferred from the second image bearing member, disposed downstream from the first contact position and upstream from a secondary transfer position where the toner images transferred from the first and second image bearing members is transferred to a recording material in a movement direction of the belt, a first transfer roller configured to transfer the toner image from the first image bearing to the belt by being applied voltage and to be in contact with an inner circumferential surface of the belt at a first transfer position at a downstream from a downstream end of the first contact position and an upstream from the second contact position in a rotation direction of the belt, a second transfer roller configured to transfer the toner image from the second image bearing to the belt by being applied voltage and to be in contact with an inner circumferential surface of the belt at a second transfer position at a downstream from a downstream end of the second contact position and an upstream from the secondary transfer position in the rotation direction of the belt a stretch roller, which is in contact with the inner surface of the belt at a position adjacent to and upstream of the first transfer position in the movement direction of the belt, configured to stretch the belt a first urging member configured to urge the first transfer roller toward the inner surface of the belt, and a second urging member configured to urge the second transfer roller toward the inner surface of the belt, wherein, in a case where image formation is performed with the first image-bearing member being in contact with the belt, the stretch roller is provided at a position opposite to and apart from the first image-bearing member with respect to a common tangent plane, which is arranged on a side of the belt, between the first image-bearing member and the second image-bearing member, wherein an urging force of the first urging member is larger than an urging force of the second urging member, and wherein the first transfer roller has an outside diameter 1.1 times to three times an outside diameter of the second transfer roller.

Further features of the present disclosure will become apparent from the following description of exemplary embodiments with reference to the attached drawings.

DESCRIPTION OF THE EMBODIMENTS

An image forming apparatus according to an exemplary embodiment of the present disclosure will be described in detail with reference to the drawings.

<1. Entire Configuration and Operation of Image Forming Apparatus>

Figure 1:
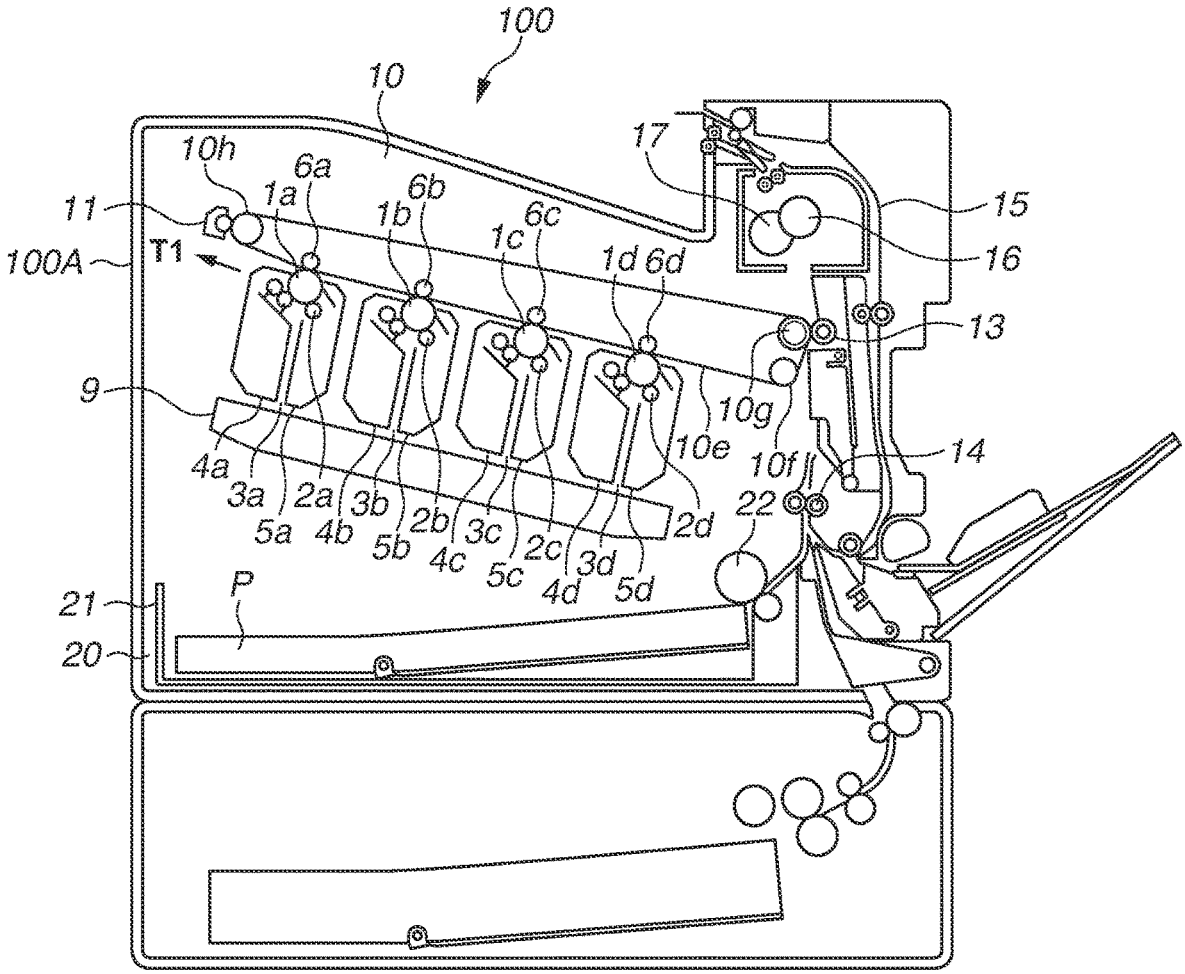
FIG. 1 is a schematic cross-sectional view of an image forming apparatus according to an exemplary embodiment of the present disclosure.

FIG. 1 is a schematic cross-sectional view of the image forming apparatus according to the exemplary embodiment of the present disclosure. The image forming apparatus 100 according to a first exemplary embodiment is a tandem laser beam printer adopting an intermediate transfer method, capable of forming a full-color image with electrophotography.

The image forming apparatus 100 includes a first image forming unit 3*a*, a second image forming unit 3*b*, a third image forming unit 3*c*, and a fourth image forming unit 3*d* as a plurality of image forming units. The image forming units 3*a*, 3*b*, 3*c*, and 3*d* form an image in yellow (Y), an image in magenta (M), an image in cyan (C), and an image in black (K), respectively.

According to the present exemplary embodiment, the respective configurations and operations of the image forming units 3*a*, 3*b*, 3*c*, and 3*d* are substantially the same except for the toner color for use. Therefore, in the description below, the image forming units will be collectively described without adding a, b, c, and d, specifying the colors for respective units, at the ends of reference numerals unless distinction among the colors is necessary.

Each image forming unit 3 includes a photosensitive drum 1 that is a drum-shaped (cylindrical) electrophotographic sensitive member (photoconductor) as an image-bearing member. The photosensitive drum 1 is driven to rotate clockwise in FIG. 1. The following units are arranged around the photosensitive drum 1. Arranged is a charging roller 2 that is a roller-shaped charging member as a charging unit. A developing device 4 is arranged as a developing unit. A drum cleaning device 5 is arranged as a photosensitive cleaning unit. For exposure of the photosensitive drums 1*a*, 1*b*, 1*c*, and 1*d*, an exposure device (laser scanner device) 9 is arranged as an exposure unit. Further, an intermediate transfer belt unit 10 as a belt conveyance device is arranged to opposed to the photosensitive drums 1*a*, 1*b*, 1*c*, and 1*d*.

The intermediate transfer belt unit 10 includes an intermediate transfer belt 10*e*, which includes an endless belt as an intermediate transfer member, opposed to the photosensitive drums 1*a*, 1*b*, 1*c*, and 1*d*. The intermediate transfer belt 10*e* is stretched around a driving roller 10*g*, a driven roller 10*f*, and a tension roller 10*h* as a plurality of rollers (stretch members). The rotational drive of the driving roller 10*g* rotates the intermediate transfer belt 10*e* counterclockwise in FIG. 1 (annular movement). As described below for details, the tension roller 10*h* is urged from an inner circumferential surface side toward an outer circumferential surface side of the intermediate transfer belt 10*e* as indicated with an arrow T1 in FIG. 1, resulting in application of a predetermined tensile force (tension) to the intermediate transfer belt 10*e*. On the inner circumferential surface side of the intermediate transfer belt 10*e*, primary transfer rollers 6*a*, 6*b*, 6*c*, and 6*d* that each are a roller-shaped primary transfer member as a primary transfer unit are arranged at the positions opposed to the photosensitive drums 1*a*, 1*b*, 1*c*, and 1*d*, respectively. Each primary transfer roller 6 is urged (pressed) by a predetermined pressure to the photosensitive drum 1 through the intermediate transfer belt 10*e*, resulting in formation of a primary transfer portion at which the intermediate transfer belt 10*e* and the photosensitive drum 1 are in contact. On the outer circumferential surface side of the intermediate transfer belt 10*e*, a secondary transfer roller 13 that is a roller-shaped secondary transfer member as a secondary transfer unit is arranged at a position opposed to the driving roller 10*g*. The secondary transfer roller 13 is urged (pressed) by a predetermined pressure to the driving roller 10*g* through the intermediate transfer belt 10*e*, resulting in formation of a secondary transfer portion at which the intermediate transfer belt 10*e* and the secondary transfer roller 13 are in contact. On the outer circumferential surface side of the intermediate transfer belt 10*e*, a belt cleaning device 11 as an intermediate-transfer-member cleaning unit is arranged at a position opposed to the tension roller 10*h*.

In addition, the image forming apparatus 100 includes a feeding device 20 that feeds a transfer medium P to the secondary transfer portion, and a fixing device 15 that fixes a toner image to the transfer medium P.

In image forming, the charging roller 2 uniformly electrostatically charges a surface of the photosensitive drum 1 rotating clockwise, and then the charged surface of the photosensitive drum 1 is subjected to scanning exposure by the exposure device 9. This arrangement causes an electrostatic latent image (electrostatic image) to be formed on the photosensitive drum 1. With toner as a developer, the developing device 4 develops the electrostatic latent image formed on the photosensitive drum 1 as a toner image. According to the present exemplary embodiment, the toner image is formed by reversal development, in which toner electrostatically charged at polarity identical to the charging polarity of the photosensitive drum 1 (negative polarity according to the present exemplary embodiment) is caused to adhere to an exposure portion (bright portion) having an absolute value reduced in potential on the photosensitive drum 1 due to the exposure after the uniformly electrostatically charging. At the primary transfer portion, the toner image formed on the photosensitive drum 1 is transferred onto the intermediate transfer belt 10*e* rotating counterclockwise by an action of the primary transfer roller 6 (primary transfer). In this case, a primary transfer power source (not illustrated) as a voltage applying unit applies to the primary transfer roller 6 primary transfer voltage (primary transfer bias) that is direct-current voltage with polarity (positive polarity according to the present exemplary embodiment) reverse to the charging polarity of the toner in development. For example, in full-color image forming, the respective toner images formed on the photosensitive drums 1*a*, 1*b*, 1*c*, and 1*d* are sequentially transferred onto the intermediate transfer belt 10*e* in superimposition.

At the secondary transfer portion, the toner image formed on the intermediate transfer belt 10*e* is transferred onto a transfer medium P, such as a recording sheet, being conveyed and sandwiched between the intermediate transfer belt 10*e* and the secondary transfer roller 13, by an action of the secondary transfer roller 13 (secondary transfer). In this case, a secondary transfer power source (not illustrated) as a voltage applying unit applies to the secondary transfer roller 13 secondary transfer voltage (secondary transfer bias) that is direct-current voltage with polarity (positive polarity according to the present exemplary embodiment) reverse to the charging polarity of the toner in development. For example, in full-color image forming, multiplexed toner images formed on the intermediate transfer belt 10*e* with four colors of toner in superimposition are conveyed by the intermediate transfer belt 10*e* to move to the secondary transfer portion. Then, the superimposed toner images are collectively transferred onto a transfer medium P at the secondary transfer portion. The transfer medium P is fed, for example, from a transfer medium cassette 21 by a feeding roller 22 in the feeding device 20, and then is conveyed to the secondary transfer portion by a registration roller 14 at the same timing of the toner image on the intermediate transfer belt 10*e*.

The transfer medium P having the toner image transferred thereto is conveyed to the fixing device 15, and then is heated and pressed at a fixing nip portion between a fixing roller 16 and a pressing roller 17 included in the fixing device 15. This arrangement causes a toner image that is unfixed on the surface of the transfer medium P to be fixed on the surface of the transfer medium P. After that, the transfer medium P is ejected (output) outside the image forming apparatus 100.

Meanwhile, residual toner on the photosensitive drum 1 after primary transferring (primary transfer residual toner) is removed from the photosensitive drum 1 by the drum cleaning device 5. With a cleaning blade as a cleaning member, the drum cleaning device 5 scrapes and removes the toner from the surface of the photosensitive drum 1 that is rotating. Residual toner on the intermediate transfer belt 10*e* after secondary transferring (secondary transfer residual toner) is removed from the intermediate transfer belt 10*e* by the belt cleaning device 11. With a cleaning blade as a cleaning member, the belt cleaning device 11 scrapes and removes the toner from the surface of the intermediate transfer belt 10*e* that is rotating. The removed toner is collected into a toner collection container (not illustrated) through a toner collection conveyance path (not illustrated).

<2. Intermediate Transfer Belt Unit>

The intermediate transfer belt unit 10 according to the present exemplary embodiment will be described. Note that, for the image forming apparatus 100 and the constituent elements thereof, the near side of the drawing of FIG. 1 and the far side of the drawing of FIG. 1 are defined as a "front side" and a "rear side", respectively. A depth direction between the front side and the rear side is substantially parallel to respective rotational axis directions of the photosensitive drums 1 and of the rollers 10*g*, 10*f*, and 10*h* around which the intermediate transfer belt 10*e* is stretched. For the intermediate transfer belt unit 10 and the constituent elements thereof, a direction corresponding to a widthwise direction of the intermediate transfer belt 10*e* (direction substantially orthogonal to the conveyance direction) is also referred to as a "thrust direction".

According to the present exemplary embodiment, the intermediate transfer belt unit 10 is detachably attached to a main body 100A of the image forming apparatus 100.

Figure 2:
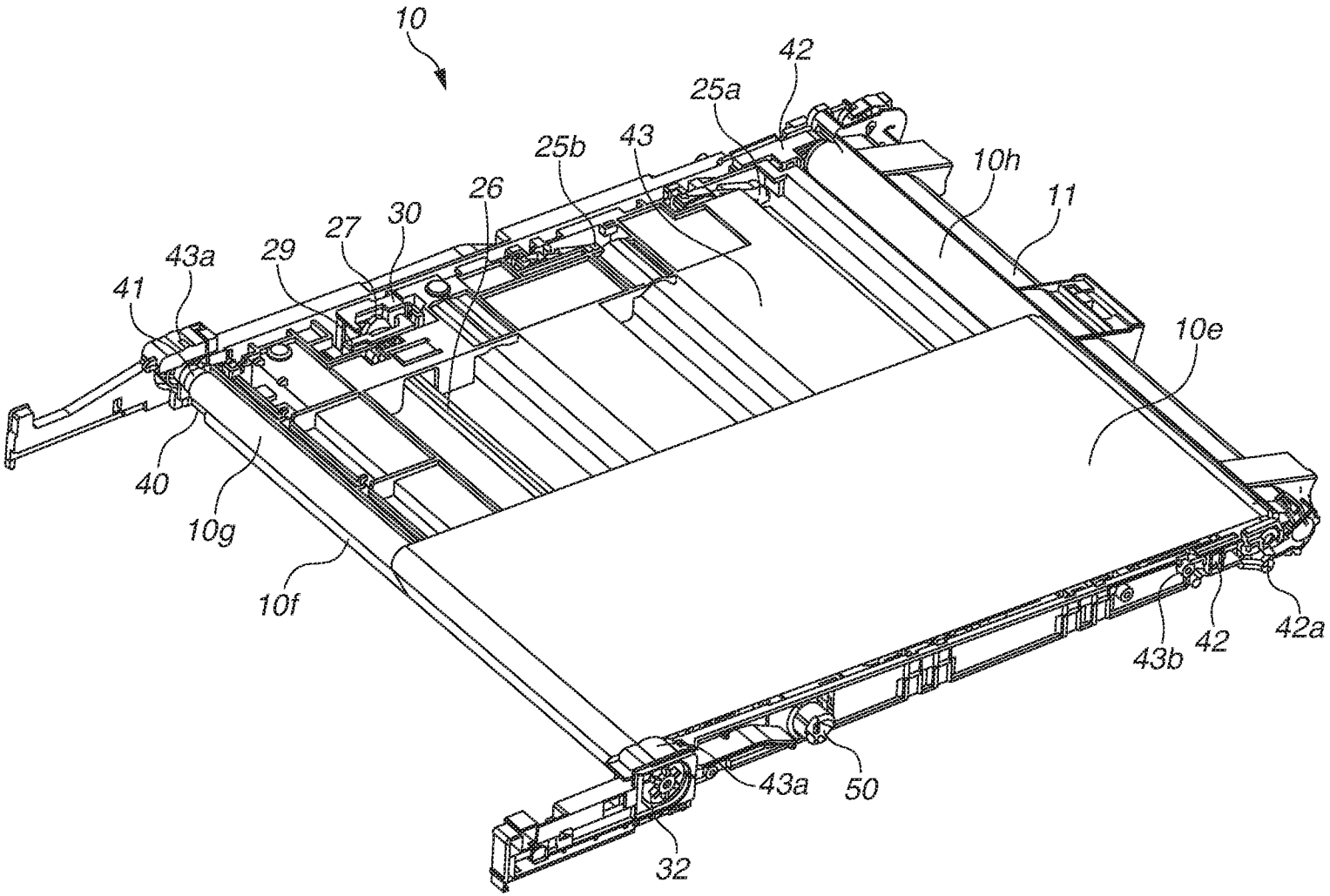
FIG. 2 is a perspective view of an intermediate transfer belt unit according to the exemplary embodiment of the present disclosure.

FIG. 2 is a perspective view of the intermediate transfer belt unit 10. The intermediate transfer belt unit 10 includes the intermediate transfer belt 10*e* (partially cut out on the front side in FIG. 2). The intermediate transfer belt unit 10 includes the driving roller 10*g*, the driven roller 10*f*, and the tension roller 10*h* as the plurality of rollers around which the intermediate transfer belt 10*e* is wound. The driving roller 10*g*, the driven roller 10*f*, and the tension roller 10*h* are attached to a frame (main frame) 43.

The driving roller 10*g* is rotatably supported by a driving-roller bearing member 41 on each end side in a longitudinal direction of the driving roller 10*g* (rotational axis direction) (illustrated only on the front side in FIG. 2). The driving-roller bearing member 41 is attached to the frame 43. The driving roller 10*g* rotates due to drive transmitted from a drive unit (not illustrated) through a drive coupling 32. Such rotational drive of the driving roller 10*g* causes conveyance of the intermediate transfer belt 10*e*. A surface of the driving roller 10*g* is formed of a rubber layer having a high coefficient of friction to convey the intermediate transfer belt 10*e* without slipping. The driving roller 10*g*, in contact with the inner surface of the intermediate transfer belt 10*e*, doubles as a secondary transfer roller that secondarily transfers the toner image formed on the intermediate transfer belt 10*e* onto a recording medium.

Figure 3:
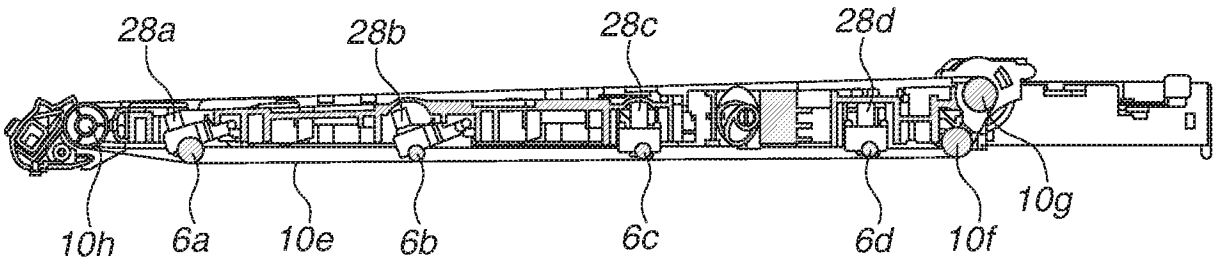
FIG. 3 is a cross-sectional view of the intermediate transfer belt unit according to the exemplary embodiment of the present disclosure.

The driven roller 10*f* is rotatably supported by a driven-roller bearing member 40 on each end side in a longitudinal direction of the driven roller 10*f* (rotational axis direction) (illustrated only on the front side in FIG. 2). The driven-roller bearing member 40 is swingably attached to the frame 43. The driven roller 10*f* rotates in accordance with the intermediate transfer belt 10*e*. Referring to FIG. 3, the driven roller 10*f* forms a primary transfer surface together with the primary transfer roller 6*a*. According to the present exemplary embodiment, the driven roller 10*f*, serving as a stretch roller that stretches the belt, functions as a regulating roller that is rotatably secured and regulates the intermediate transfer belt 10*e* at least during image forming. The position allows the driven roller 10*f* substantially in contact with a common tangent plane between the photosensitive drums 1. The tension roller 10*h* is provided at a position adjacent to the primary transfer roller 6*a* upstream of the primary transfer roller 6*a* in a movement direction of the intermediate transfer belt 10*e*. As illustrated in FIG. 3, the tension roller 10*h* is provided at a position opposite to and apart from the photosensitive drums 1 with respect to the common tangent plane between the photosensitive drums 1. The tension roller 10*h* is rotatably supported by a tension-roller bearing member (here, also simply referred to as a "bearing member") 42 on each end side in a longitudinal direction of the tension roller 10*h* (rotational axis direction). The bearing member 42 is attached to the frame 43, movably (slidably) and swingably in the pressure direction of the intermediate transfer belt 10*e*. The bearing member 42 on each end side in the longitudinal direction of the tension roller 10*h* is urged by a compressive force of a tension spring (not illustrated) including a compression spring as an urging unit. The bearing member 42 moves (slides) from the inner circumferential surface side to the outer circumferential surface side of the intermediate transfer belt 10*e* along an urging direction of the tension spring. This arrangement allows the tension roller 10*h* to urge the intermediate transfer belt 10*e* from the inner circumferential surface side to the outer circumferential surface side of the intermediate transfer belt 10*e* to apply a tensile force to the intermediate transfer belt 10*e*. The belt cleaning device 11 is provided at the position opposed to the tension roller 10*h*.

A separation coupling 50 is provided on the rear side of the intermediate transfer belt unit 10. Rotation of the separation coupling 50 allows detachment and attachment of primary transfer rollers 6.

Positioning of the intermediate transfer belt unit 10 to the main body 100A is performed through rails, which are not illustrated, positioned to a main body frame. Because positioning of each image forming unit 3 is performed to the main body frame, the positional relationship between the intermediate transfer belt unit 10 and each image forming unit 3 is accurately assured. Abutment portions for positioning of the frame 43 and a portion for positioning of the tension-roller bearing member 42 provided at each rail engage with positioning portions 43*a* and 43*b* of the frame 43 and a positioning portion 42*a* of the tension-roller bearing member 42, resulting in fitting and positioning.

<3. Belt-Deviation Regulation>

Belt-deviation regulation that intermediate transfer belt unit 10 performs will be described. The driving roller 10*g* rotates the intermediate transfer belt 10*e* with the driving roller 10*g*, the tension roller 10*h*, the driven roller 10*f*, and the primary transfer rollers 6 abutting on or giving an urging force to the inner circumferential surface. In that case, depending on the dimensions and shape of each roller and the positional relationship between the rollers, the intermediate transfer belt 10*e* moves in the thrust direction (belt deviation). The belt-deviation regulation is a technique of inhibiting the intermediate transfer belt 10*e* from moving in the thrust direction to rotate the intermediate transfer belt 10*e* stably.

Figure 8:
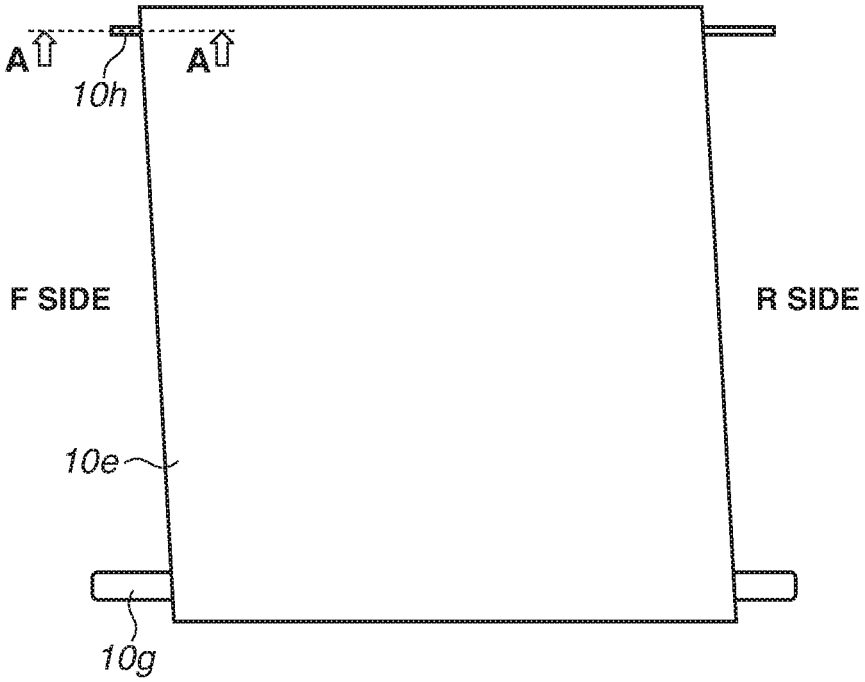
FIG. 8 illustrates belt-deviation regulation with a tension roller.
Figure 8:
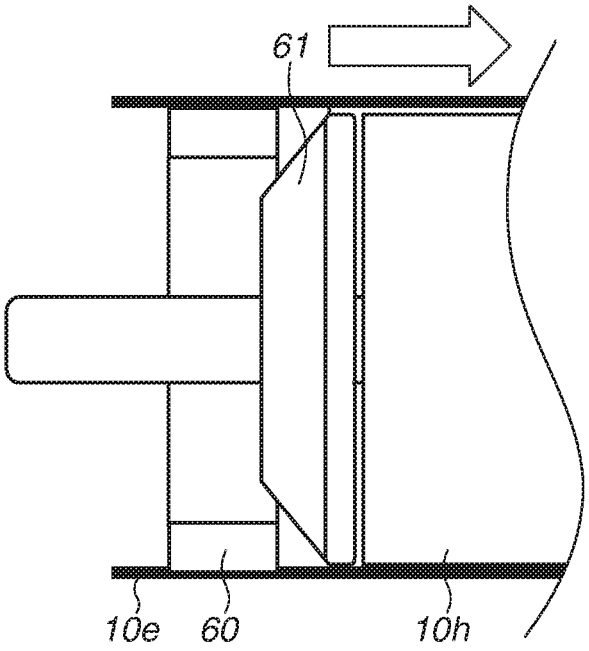

FIG. 8 is a schematic view of a regulated state due to the belt-deviation regulation. Referring to an A-A cross-sectional view of FIG. 8, a flange 61 having a slope is provided at each end of the tension roller 10*h*. The intermediate transfer belt 10*e* is provided with a rib 60. In a case where the intermediate transfer belt 10*e* stretched around the tension roller 10*h* has belt deviation in a direction of an arrow of FIG. 8, the flange 61 and the rib 60 in contact inhibit the intermediate transfer belt 10*e* from moving. In that case, as in FIG. 8, the stretch positions of the intermediate transfer belt 10*e* with the tension roller 10*h* and the driving roller 10*g* in the thrust direction of the intermediate transfer belt 10*e* vary with respect to a portion subjected to the belt-deviation regulation. The variation causes the intermediate transfer belt 10*e* to be pulled between a belt-regulating position and an R side of the driving roller 10*g*, so that slack occurs between the R side of the tension roller 10*h* and an F side of the driving roller 10*g*. The slack causes instability on the belt, so that belt waving occurs.

<4. Primary Transfer Portion>

FIG. 3 illustrates the present exemplary embodiment. The primary transfer rollers 6 are arranged in contact with the inner surface of the intermediate transfer belt 10*e* that rotates counterclockwise in the figure. The primary transfer surface is formed by the primary transfer roller 6*a*, which is most upstream of the secondary transfer portion, and the driven roller 10*f*, which is arranged closest to the secondary transfer portion. A secondary transfer surface is formed by the driven roller 10*f* and the driving roller 10*g*.

Figure 4:
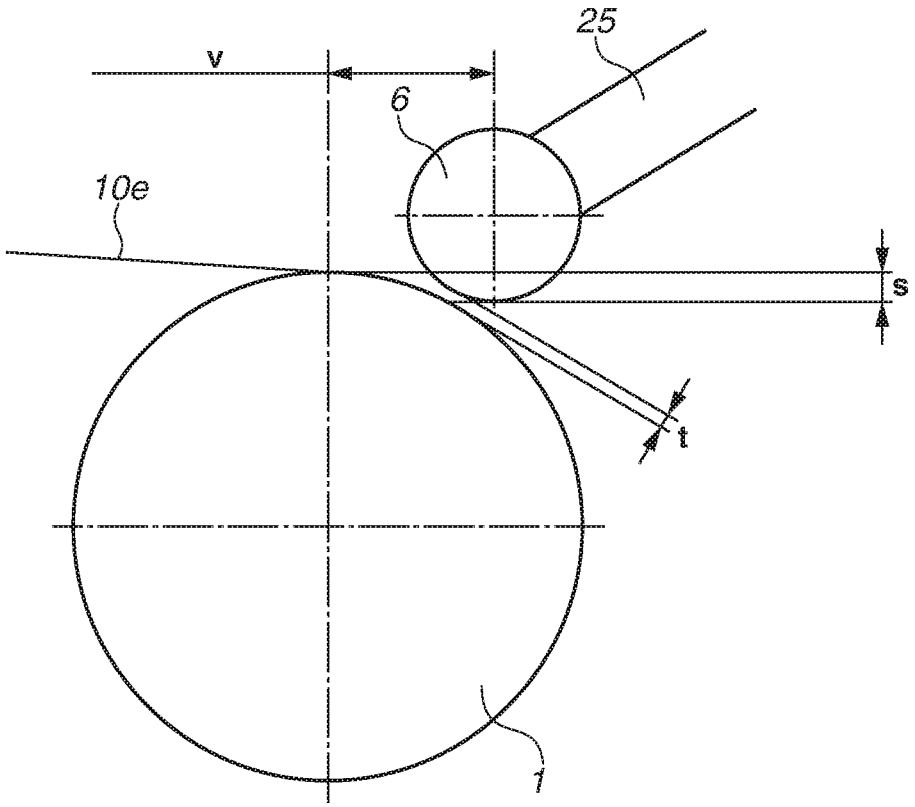
FIG. 4 illustrates an arrangement of a photosensitive drum and a primary transfer roller according to the exemplary embodiment of the present disclosure.

As illustrated in FIG. 4, the primary transfer roller 6 has a shaft supported by a primary transfer holder 25, which is linearly supported or rotationally supported by the frame 43. A pressing spring 28 as an urging member, which is provided between the primary transfer holder 25 and the frame 43, presses the primary transfer roller 6 to the photosensitive drum 1. According to the present exemplary embodiment, the primary transfer rollers 6 are metal rollers formed of metal. As illustrated in FIG. 4, the primary transfer roller 6 is arranged in contact with the inner circumferential surface of the intermediate transfer belt 10*e* with a gap t between the photosensitive drum 1 and the primary transfer roller 6. The primary transfer roller 6 is offset by V mm downstream of the photosensitive drum 1 in the movement direction of the intermediate transfer belt 10*e*. That is each photosensitive drum 1 is in contact with the intermediate transfer belt 10*e* at the primary transfer portion, resulting in formation of the primary transfer portion. Each primary transfer roller 6 is arranged in contact with the intermediate transfer belt 10*e*, which is downstream of a downstream end of the corresponding primary transfer portion in the movement direction of the intermediate transfer belt 10*e*. Application of the transfer bias causes each primary transfer roller 6 to transfer the toner image borne on the photosensitive drum 1 onto the intermediate transfer belt 10*e*.

Figure 5A:
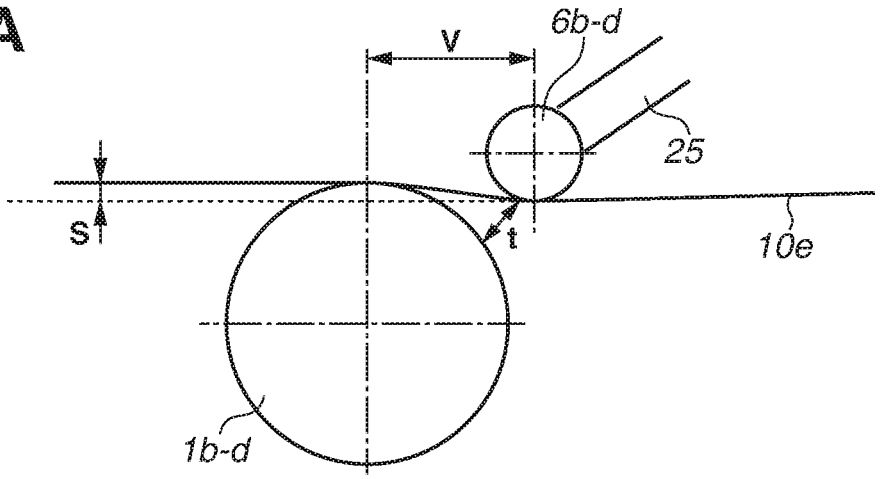
FIGS. 5A to 5C each illustrate an arrangement of the photosensitive drum and the primary transfer roller according to the exemplary embodiment of the present disclosure.
Figure 5B:
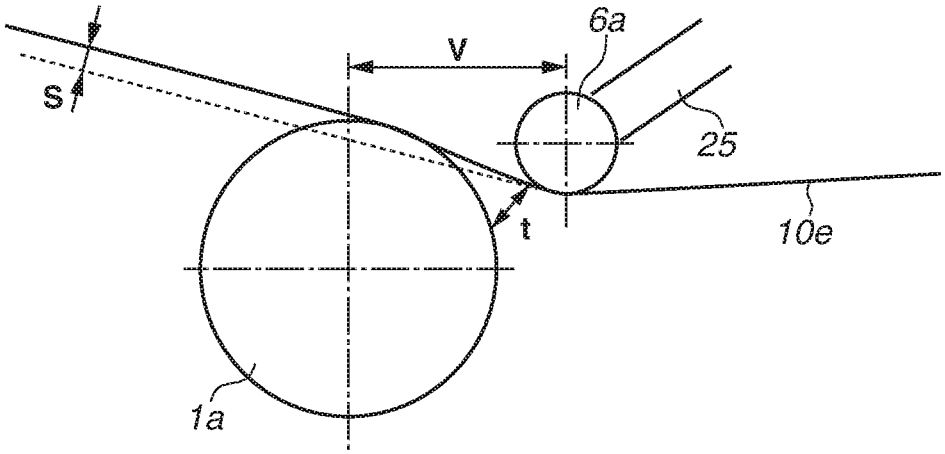
Figure 5C:
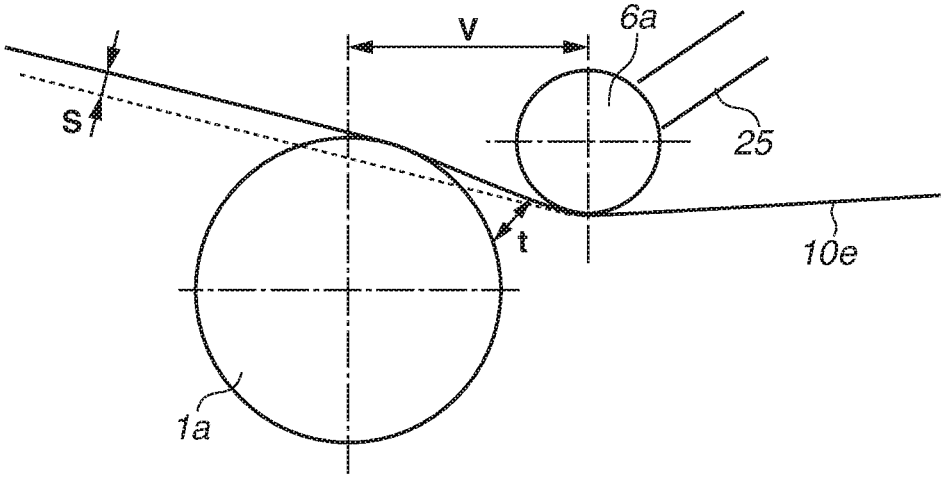

The offset distance V is a distance between a perpendicular from a rotational central axis of each photosensitive drum 1 to the common tangent plane among the photosensitive drums 1 and a perpendicular from a rotational central axis of the primary transfer roller 6 to the tangent plane (in a direction of the tangent plane). According to the present exemplary embodiment, the primary transfer roller 6 protrudes the intermediate transfer belt 10*e* by S mm from the inner circumferential surface side to the outer circumferential surface side, substantially vertically to the tangent plane (in a downward direction of FIG. 4). Referring to FIG. 5A, S is an amount of protrusion of the primary transfer rollers 6*b* to 6*d* with respect to the portions of belt surfaces in contact with the photosensitive drums 1*b* to 1*d* upstream of the photosensitive drums 1*b* to 1*d*. Referring to FIGS. 5B and 5C, S is an amount of protrusion of the primary transfer roller 6*a* with respect to a tangent (belt surface) inscribed with the photosensitive drum 1*a* and the upstream roller (tension roller 10*h*).

The relationship between the primary transfer roller 6 and the photosensitive drum 1 described above is illustrated in FIG. 5A, and is applied to the primary transfer rollers 6*b* to 6*d* and the photosensitive drums 1*b* to 1*d*. The position of the primary transfer roller 6 is determined at the position where the urging force of the spring urging the primary transfer roller 6, the weight of the primary transfer roller 6 itself, and the tensile force of the intermediate transfer belt 10*e* are in balance. Thus, the respective primary transfer rollers 6*b* to 6*d* require at least a minimum of urging force for urging to the belt inner surface, and are smaller in pressure than the primary transfer roller 6*a*. Meanwhile, according to the present exemplary embodiment, the urging force for urging the primary transfer roller 6*a* to the belt inner surface is set larger than those for the primary transfer rollers 6*b* and 6*d*. A reason for this is that belt waving occurring due to the tension roller 10*h* is to be inhibited. Another reason is that a belt load of the primary transfer roller 6*a* is large due to the tension roller 10*h* located apart from the primary transfer surface as illustrated in FIG. 5B. In a case where the primary transfer roller 6*a* is identical in outside diameter to the other rollers, the arrangement in FIG. 5B is applied. Since the tension roller 10*h* is located upstream of the primary transfer roller 6*a*, which is most upstream of the secondary transfer portion, there is an oblique to the common tangent plane among the photosensitive drums 1 as illustrated in FIG. 5B. Thus, because the amount of protrusion S mm is set to the oblique belt surface, there are differences among the respective relationships between the primary transfer rollers 6*b* to 6*d* and the photosensitive drums 1*b* to 1*d*, regarding, for example, the offset distance V and the position of a sliding direction to the photosensitive drum 1 in the figure (not illustrated). In a case where the primary transfer roller 6*a* is increased in outside diameter, the arrangement in FIG. 5C is applied. In comparison to FIG. 5B, the variation in outside diameter varies the offset distance V and the position of the sliding direction to the photosensitive drum 1 in the figure (not illustrated). This is because the belt distance between the photosensitive drum 1 and the primary transfer roller 6 requires making constant even in a case where the outside diameter has increased. Thus, the offset distance V requires increasing and the primary transfer roller 6 requires moving upward by the increase in diameter for the amount of protrusion S.

Figure 6A:
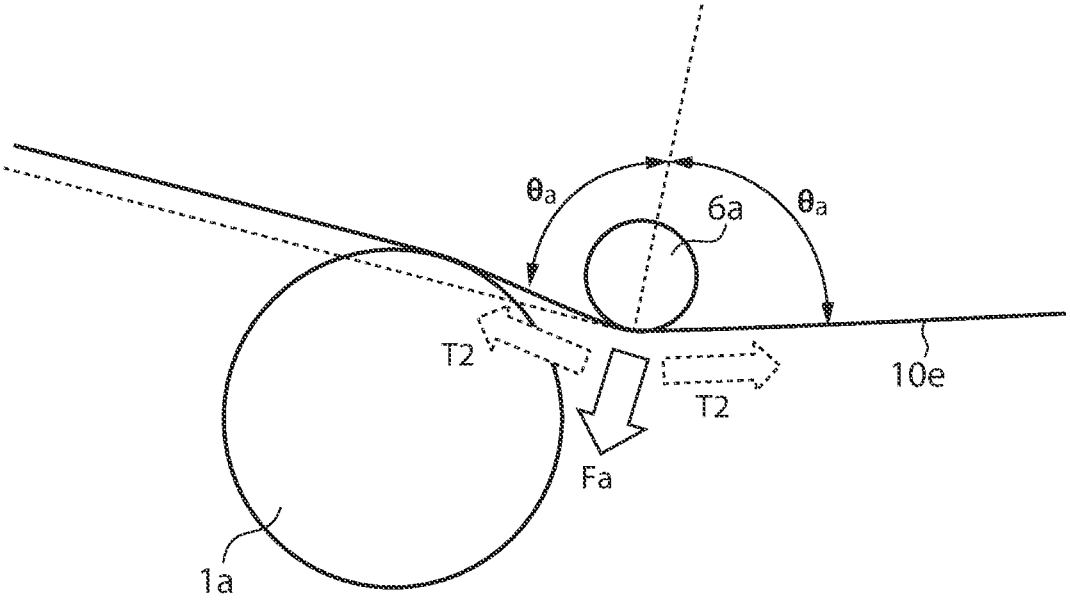
FIGS. 6A and 6B each illustrate an urging force of the primary transfer roller toward a belt.
Figure 6B:
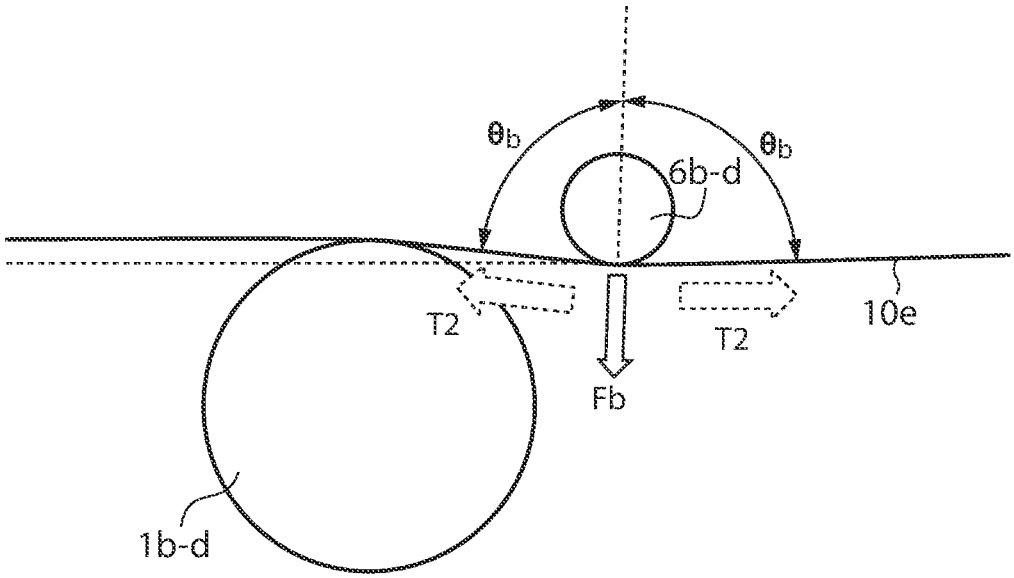

FIG. 6A illustrates urging force F necessary for the primary transfer roller 6*a*, which is most upstream of the secondary transfer portion, to push the intermediate transfer belt 10*e* into a desired position. FIG. 6B illustrates urging force F necessary for each of the other primary transfer rollers 6*b* to 6*d* to push the intermediate transfer belt 10*e* into a desired position. FIG. 6A illustrates the primary transfer portion most upstream of the secondary transfer portion. FIG. 6B illustrates each of the other primary transfer portions. The intermediate transfer belt 10*e* is given the tensile force T2 by the tension roller 10*h*. On the basis of the angle θ between the belt pushed to the desired position with each primary transfer roller 6 given the urging force F and a line connecting the center of the primary transfer roller 6 and the portion of the primary transfer roller 6 with which the belt is in contact, the following expression is satisfied: $F=2\times(T2 \cos \theta)$. As illustrated in FIGS. 6A and 6B, because of a difference in belt angle between the primary transfer roller 6*a*, which is most upstream of the secondary transfer portion, and each of the other primary transfer rollers 6*b* to 6*d*, the following relationship is satisfied: $Fa>Fb$.

Figure 7A:
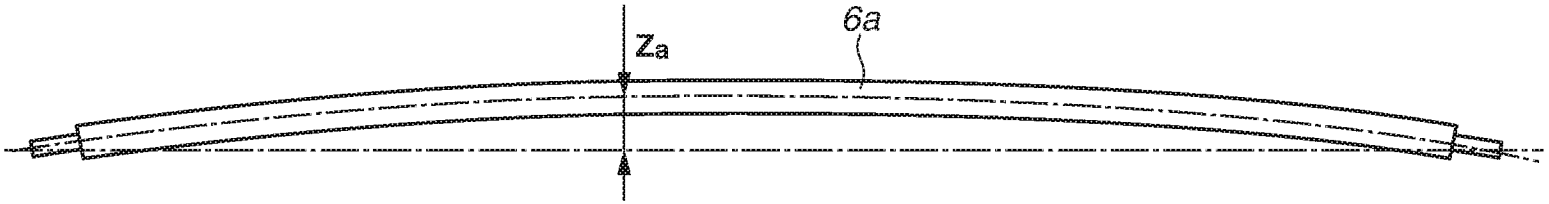
FIGS. 7A, 7B and 7C each illustrate the deformation of the primary transfer roller.
Figure 7B:
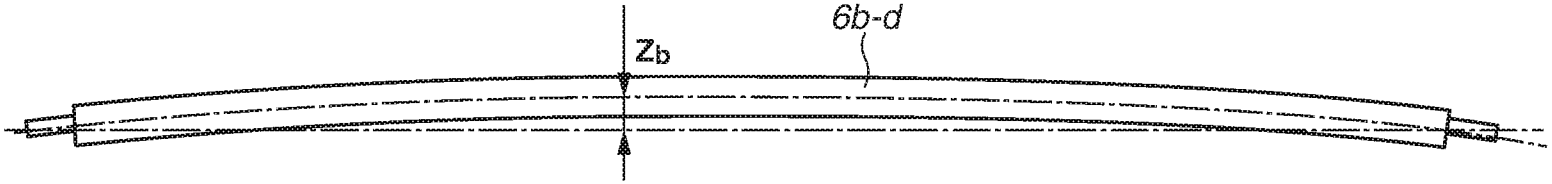
Figure 7C:
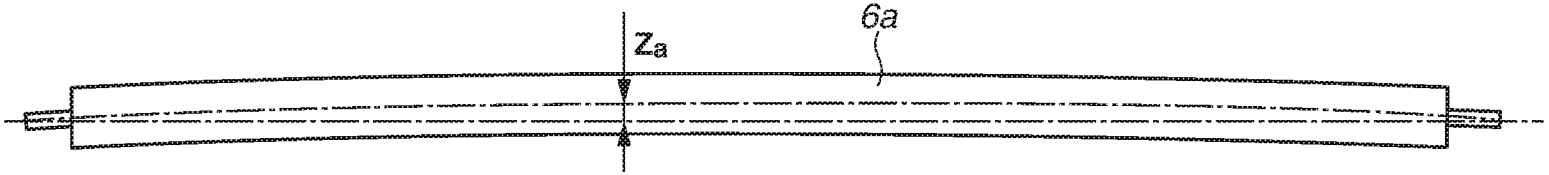

As illustrated in FIGS. 7A to 7C, an amount of minute deformation of each primary transfer roller 6 due to the urging force F, is defined as Z. As in FIGS. 7A and 7B, the amount of deformation Za at the most upstream primary transfer portion is larger than the amount of deformation Zb at each of the other primary transfer portions. With the primary transfer rollers 6*b* to 6*d* interposed between the driven roller 10*f* and the primary transfer roller 6*a*, the belt surface is stable, resulting in no problem. The most upstream primary transfer roller 6*a* doubles as the function of primary transferring and the function of forming the primary transfer surface. Thus, an increase in the amount of deformation Za causes non-uniform contact with the belt, so that the primary transfer surface is unstable. Therefore, the following relationship is desirably satisfied in the amount of deformation Z: $Za<Zb$. As illustrated in FIG. 7C, the primary transfer roller 6*a* requires making larger in outside diameter than the primary transfer rollers 6*b* to 6*d*. According to the present exemplary embodiment, the primary transfer roller 6*a* is φ8 in outside diameter, and the primary transfer rollers 6*b* to 6*d* each are φ6 in outside diameter. In this manner, the difference in outside diameter between the primary transfer roller 6*a* and the primary transfer rollers 6*b* to 6*d* enables stabilization of the primary transfer surface and inhibition of an increase in cost.

The primary transfer roller 6*a* desirably has an outer diameter 1.1 times to three times an outside diameter of each of the primary transfer rollers 6*b* to 6*d*. The outer diameter of the primary transfer roller 6*a* less than the 1.1 times reduces the effect of inhibiting deformation. The outer diameter of the primary transfer roller 6*a* more than the three times causes an increase in cost and prevents a reduction in weight.

A second exemplary embodiment is different from the above described first exemplary embodiment in terms of a belt-deviation regulation method. Except for the method, the second exemplary embodiment is similar in configuration to the first exemplary embodiment.

<Belt-Deviation Regulation (Steering Roller)>

Figure 9:
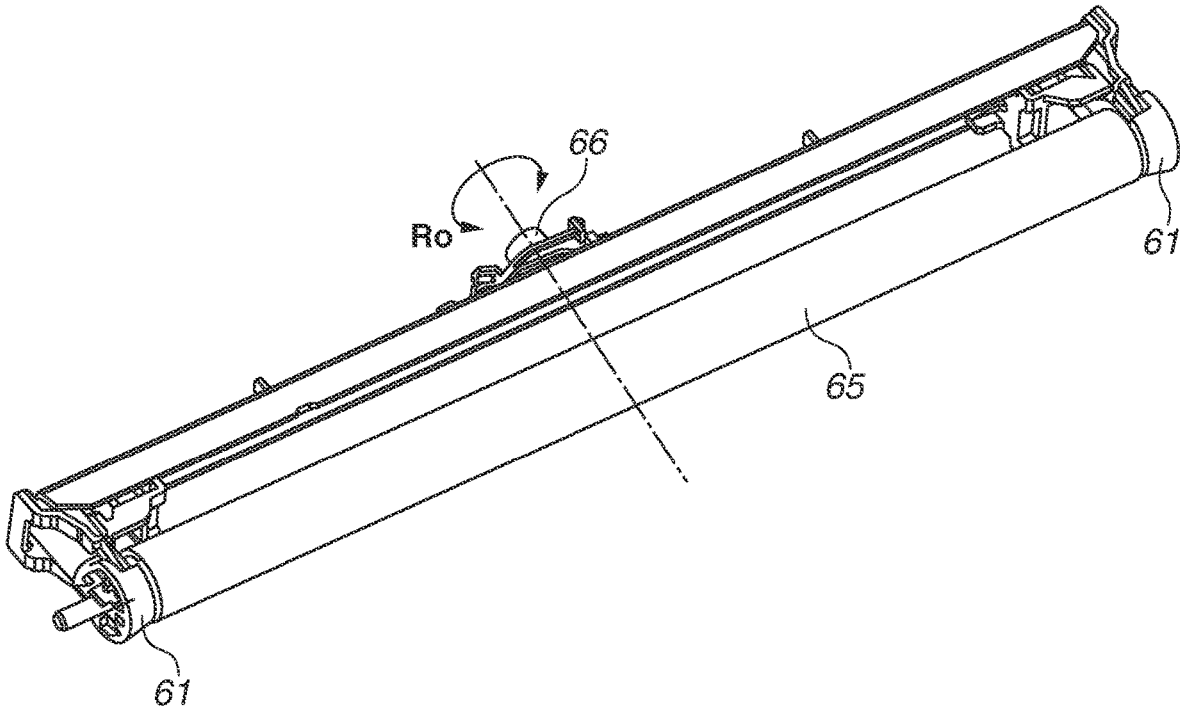
FIG. 9 is a schematic view of a steering roller according to a second exemplary embodiment.
Figure 10A:
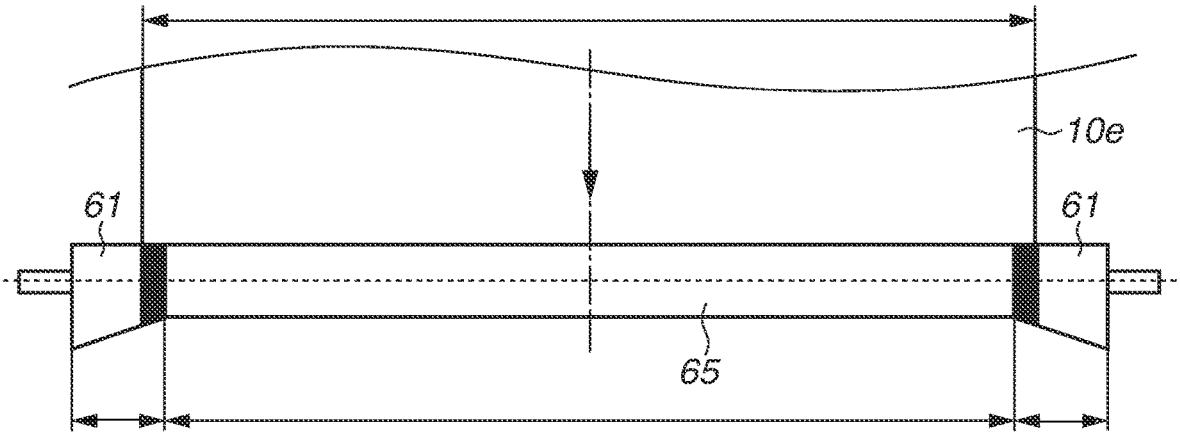
FIGS. 10A and 10B each illustrate belt-deviation regulation with the steering roller according to the second exemplary embodiment.
Figure 10B:
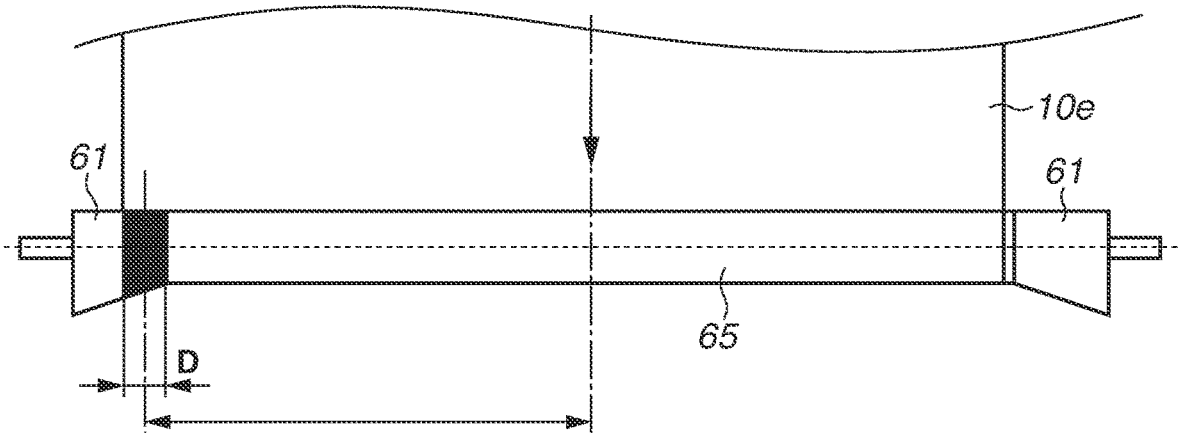

A steering roller 65 illustrated in FIG. 9 is provided at the position of the tension roller 10*h* according to the first exemplary embodiment, and is swingably attached around a steering shaft 66 crossing the rotational axis direction of the steering roller 65 as indicated with an arrow Ro. A flange 61 is provided at each end of the steering roller 65, and an end of a stretched intermediate transfer belt 10*e* overlaps the slope of the flange 61 as illustrated in FIG. 10A. Occurrence of belt deviation increases an amount of overlap D to the slope of either of the flanges 61 as in FIG. 10B, resulting in an increase in a frictional force between the belt and the flange 61. Then, most of a rotational force of the belt is transmitted to the steering roller 65. The transmitted force rotates the steering roller 65 around the steering shaft 66, resulting in occurrence of torsion on the belt. The torsion generates opposite belt deviation, so that the position of the belt is automatically adjusted to substantially the center in the thrust direction. Even in such lateral movement control of the belt with the steering roller 65 as described above, enhancement of the urging force for urging a primary transfer roller 6*a* to the belt enables inhibition of belt waving from influencing a primary transfer surface. Further, making the primary transfer roller 6*a* larger in outside diameter than primary transfer rollers 6*b* to 6*d* enables inhibition of the primary transfer roller 6*a* from deforming with inhibition of an increase in cost.

In each exemplary embodiment, each of the primary transfer rollers has been described as a metal roller, but is not limited to this. The present disclosure can be applied as long as no nip is formed between each primary transfer roller and each photosensitive drum through the belt. For example, each primary transfer roller can be a transfer roller having a surface provided with a coat layer, such as resin.

The present disclosure can provide a transfer unit enabling a reduction in size of an apparatus and a reduction in cost while inhibiting belt waving from influencing transferring, even without nip formed between a primary transfer roller and a drum through a belt.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

a first image bearing member configured to bear a toner image;

a second image bearing member configured to bear a toner image;

a belt, which is movably provided, configured to be in contact with the first image bearing member at a first contact portion where the toner image is transferred from the first image bearing member and to be in contact with the second image bearing member at a second contact portion, where the toner image is transferred from the second image bearing member, disposed downstream of the first contact portion and upstream of a secondary transfer portion where the toner images transferred from the first and second image bearing members are transferred to a recording material in a movement direction of the belt;

a first transfer roller configured to transfer the toner image from the first image bearing member to the belt by being supplied with voltage and to be in contact with an inner circumferential surface of the belt at a first transfer portion, wherein an upstream end of the first transfer portion is downstream of a downstream end of the first contact portion and upstream of the second contact portion in the movement direction of the belt;

a second transfer roller configured to transfer the toner image from the second image bearing member to the belt by being supplied with voltage and to be in contact with an inner circumferential surface of the belt at a second transfer portion, wherein an upstream end of the second transfer portion is downstream of a downstream end of the second contact portion and upstream of the secondary transfer portion in the movement direction of the belt;

a stretch roller provided upstream of the first transfer roller and adjacent to the first transfer roller in the movement direction of the belt and configured to stretch the belt, wherein, in a case where image formation is performed with the first image bearing member and the second image bearing member being in contact with the belt, the stretch roller is disposed at a position opposite to the first image bearing member with respect to a common contact plane of the first image bearing member and the second image bearing member passing through the first contact portion and the second contact portion and spaced from the common contact plane, wherein a distance between a perpendicular from a rotational center of the first image bearing member to the common contact plane and a perpendicular from a rotational center of the first transfer roller to the common contact plane is longer than a distance between a perpendicular from a rotational center of the second image bearing member to the common contact plane and a perpendicular from a rotational center of the second transfer roller to the common contact plane, and wherein an amount of protrusion of the first transfer roller with respected to the common contact plane is larger than an amount of protrusion of the second transfer roller with respected to the common contact plane.

2. The image forming apparatus according to claim 1, wherein the first transfer roller has an outside diameter 1.1 times to 3 times an outside diameter of the second transfer roller.

3. The image forming apparatus according to claim 1, wherein each of the first transfer roller and the second transfer roller is a metal roller having a surface formed of metal.

4. The image forming apparatus according to claim 1, wherein the stretch roller is a tension roller movably provided from an inner surface side to an outer surface side of the belt in image forming, and applies tension to the belt.

5. The image forming apparatus according to claim 1, further comprising:

a first urging member configured to urge the first transfer roller toward the inner surface of the belt; and a second urging member configured to urge the second transfer roller toward the inner surface of the belt, wherein an urging force of the first urging member is larger than an urging force of the second urging member.

6. An image forming apparatus comprising:

a first image bearing member configured to bear a toner image;

a second image bearing member configured to bear a toner image;

a belt, which is movably provided, configured to be in contact with the first image bearing member at a first contact portion where the toner image is transferred from the first image bearing member and to be in contact with the second image bearing member at a second contact portion, where the toner image is transferred from the second image bearing member, disposed downstream of the first contact portion and upstream of a secondary transfer portion where the toner images transferred from the first and second image bearing members are transferred to a recording material in a movement direction of the belt;

a first transfer roller configured to transfer the toner image from the first image bearing member to the belt by being supplied with voltage and to be in contact with an inner circumferential surface of the belt at a first transfer portion that is out of the first contact portion in the movement direction of the belt;

a second transfer roller configured to transfer the toner image from the second image bearing member to the belt by being supplied with voltage and to be in contact with an inner circumferential surface of the belt at a second transfer portion that is out of the second contact portion in the movement direction of the belt;

a first urging member configured to urge the first transfer roller toward the inner surface of the belt;

a second urging member configured to urge the second transfer roller toward the inner surface of the belt;

a stretch roller provided upstream of the first transfer roller and adjacent to the first transfer roller in the movement direction of the belt and configured to stretch the belt, wherein, in a case where image formation is performed with the first image bearing member and the second image bearing member being in contact with the belt, the stretch roller is disposed at a position opposite to the first image bearing member with respect to a common contact plane of the first image bearing member and the second image bearing member passing the first contact portion and the second contact portion and spaced from the common contact plane, wherein an urging force of the first urging member is larger than an urging force of the second urging member, and wherein the first transfer roller has an outside diameter 1.1 times to 3 times an outside diameter of the second transfer roller.

7. The image forming apparatus according to claim 6, wherein the first transfer roller is not in contact with a region of the belt upstream of the stretch roller and downstream of the second transfer roller in the movement direction of the belt.

8. The image forming apparatus according to claim 6, wherein each of the first transfer roller and the second transfer roller is a metal roller having a surface formed of metal.

9. The image forming apparatus according to claim 6, wherein the stretch roller is a tension roller movably provided from an inner surface side to an outer surface side of the belt in image forming, and applies tension to the belt.

10. The image forming apparatus according to claim 6, wherein an upstream end of the first transfer portion is provided downstream of a downstream end of the first contact portion and upstream of the second contact portion in the movement direction of the belt, and an upstream end of the second transfer portion is provided downstream of a downstream end of the second contact portion and upstream of the secondary transfer portion in the movement direction of the belt.

* * * * *